United States Patent [19]

Staude et al.

[11] 4,037,442

[45] July 26, 1977

[54] CLOAKROOM BRACELET FOR BATHING ESTABLISHMENTS AND THE LIKE

[75] Inventors: Heinz Staude; Fritz Goesswald, both of Peiting, Germany

[73] Assignee: Eulit Werk Staude & Co. KG, Peiting, Germany

[21] Appl. No.: 681,701

[22] Filed: Apr. 29, 1976

[30] Foreign Application Priority Data

| | | |
|---|---|---|
| Sept. 4, 1975 | Germany | 7527905 |
| Jan. 29, 1976 | Germany | 2603264 |

[51] Int. Cl.[2] ..... A47G 29/10

[52] U.S. Cl. ..... 70/456 R; 224/28 E

[58] Field of Search ..... 70/456–459; 24/3 K; 150/40; 224/28 R, 28 B, 28 E

[56] References Cited

U.S. PATENT DOCUMENTS

| | | | |
|---|---|---|---|
| 2,078,325 | 4/1937 | Hallock | 150/40 X |
| 2,728,501 | 12/1955 | Hill | 70/456 R |
| 3,119,249 | 1/1964 | Goldstein | 70/456 R |
| 3,144,935 | 8/1964 | Geyler | 150/40 X |

FOREIGN PATENT DOCUMENTS

| | | | |
|---|---|---|---|
| 732,949 | 4/1966 | Canada | 70/456 R |
| 807,979 | 7/1951 | Germany | 70/456 R |

*Primary Examiner*—Robert L. Wolfe

*Attorney, Agent, or Firm*—Blanchard, Flynn, Thiel, Boutell & Tanis

[57] ABSTRACT

A cloakroom bracelet for bathing establishments consisting of a flexible strap made of synthetic resin having at one end a buckle and a recess in its middle part for accommodation of a flat key having a key handle joined on a pivot to the strap. The recess is designed as a pocket which opens toward one of the narrow edges of the strap and the key handle is pivotal into and out of the pocket about an axis extending at right angles to the plane of the strap.

4 Claims, 5 Drawing Figures

A
1
1a
2
3
4
5
6.
6a
7
8
9.
10
11
11a
11b
12
II
III
IV

CLOAKROOM BRACELET FOR BATHING ESTABLISHMENTS AND THE LIKE

FIELD OF THE INVENTION

The invention concerns a coakroom bracelet for bathing establishments and the like, consisting of a flexible strap of synthetic resin which has a buckle at one end and in its middle part a recess for accomodating a flat key joined on a pivot to the strap.

BACKGROUND OF THE INVENTION

In a known cloakroom bracelet of this kind, made of rubber, the strap is thickened in it middle part and has a pocket open toward the interior of the strap. A plate is riveted into this pocket, to which only the key-bit of a flat key (cylinder-lock key) is articulated so as to swivel about an axis extending parallel to the plane of the strap. This known bracelet is, however, costly to manufacture. That is to say, it provides for a special key which consists of the said bearing plate, the key-bit, and a swivel axis penetrating the key-bit and disposed parallel to its breadth. Since the key-bit of a cylinder-lock normally has a thickness of only about 2 mm, this swivel axis is very thin and is, therefore, easily damaged, the more so as it has to transmit torsional forces when the lock is opened or closed. Moreover, the bearing plate must be fixed in the strap by several rivets or the like. Further, the manipulation of the key is awkward because the key-bit extending at right angles to the plane of the strap cannot be gripped directly, but only on the strap. Because of its swivelling bearing it may swing away upon insertion into the lock. Finally, it is also a drawback that the key-bit when swivelled-in lies against the skin. Sharp key-bit edges may lead to injuries.

The task of the invention is to provide a cloakroom bracelet of the kind mentioned initially, which is simpler to manufacture and with which a normal, easily manipulated, flat key (cylinder-lock key) can be used, and with which, moveover, the in the swivelled-in position is covered by the strap in such a way that it cannot come into contact with the skin and thereby the risk of injury is eliminated.

According to the invention this is achieved in that the recess is designed as a pocket opening toward a narrow face of the strap and in that the key handle swivels into and out of the pocket around a pivot penetrating into the pocket and extending perpendicular to the plane of the strap.

Thanks to this arrangement, a normal commercial, flat key (cylinder-lock key) can be employed. In the swung-in position, the key-bit is completely surrounded by the pocket and therefore contact with the skin is avoided. Since the strap consists of flexible synthetic material, the strap and the pocket acquire a curvature when placed on the wrist or ankle, which leads to the inside of the pocket lying closely against the key and the mouth of the pocket being partially closed. Thereby, when the cloakroom bracelet has been put on, the key can no longer be swivelled out of the pocket. On the other hand, if the bracelet is taken off the arm, the strap, on account of its elasticity, reverts to its flat shape. Also the pocket again becomes straight and the key can readily be swivelled out of the pocket. Since it is a matter of an ordinary key and since this key extends in the plane of the strap it is also extremely easy to manipulate. The bracelet can be extruded together with the pocket, in one piece, and the key can be joined to the bracelet in a simple manner by a rivet or nut passing through the strap. By this design and the employment of a normal commercial key the cloakroom bracelet also becomes inexpensive to manufacture.

A specially advantageous development of the new cloakroom bracelet consists of its having on the mouth side of the pocket two parallel lugs, at a distance apart, which extend substantially at right angles to the narrow side and in the plane of the strap, and near their free ends are each furnished with a drilling for the swivel axis of the key located between the lugs, which key when in the swung-in position extends substantially at right angles to the length of the strap. This design has above everything else the advantage that the bracelet can adapt to the arm unhindered by the key. At the same time, the pocket completely closes near to the key-bit because of the flexure of the strap which has been put on, so that the key is securely held in the pocket. The projecting lug also facilitates the grasping of the key handle.

It is advisable that the pocket should have a mouth only on the one side of the two lugs and should have a stop inside it for the key. The swivelling of the key is restricted by this stop in such a way that in the swung-in position the key, together with its key-bit, extends approximately perpendicularly to the lengthwise direction of the strap. The stop defines the correct attitude of the key in the swung-in position. The stop also has the advantage that the key cannot swivel out to one side if the bracelet is hung up on a key board by its buckle.

Advantageously, moreover, the lugs in the plane of the strap are narrower than the key handle. In this way the usually disc-shaped or polygonal key handle projects laterally beyond the lugs, its edge can be grasped, and hence the key can easily be swivelled out of the pocket when the bracelet is taken off.

In order to facilitate the swivelling of the key into the pocket, the edges of the mouth of the pocket are advantageously bevelled toward the inside of the pocket.

BRIEF DESCRIPTION OF THE DRAWING

In what follows, the invention is explained in more detail by means of the embodying example illustrated in the drawing in which:

FIG. 1 shows a plan view of the cloakroom bracelet from the outside;

FIG. 2 shows a side view of a partial section along the line II—II of FIG. 1;

FIG. 3 shows a section along the line III—III of FIG. 1;

FIG. 4 shows a section along the line IV—IV of FIG. 1; and

FIG. 5 shows the cloakroom bracelet as put on with the key swivelled in.

DETAILED DESCRIPTION

Figures 1, 2, 3, 4, 5:
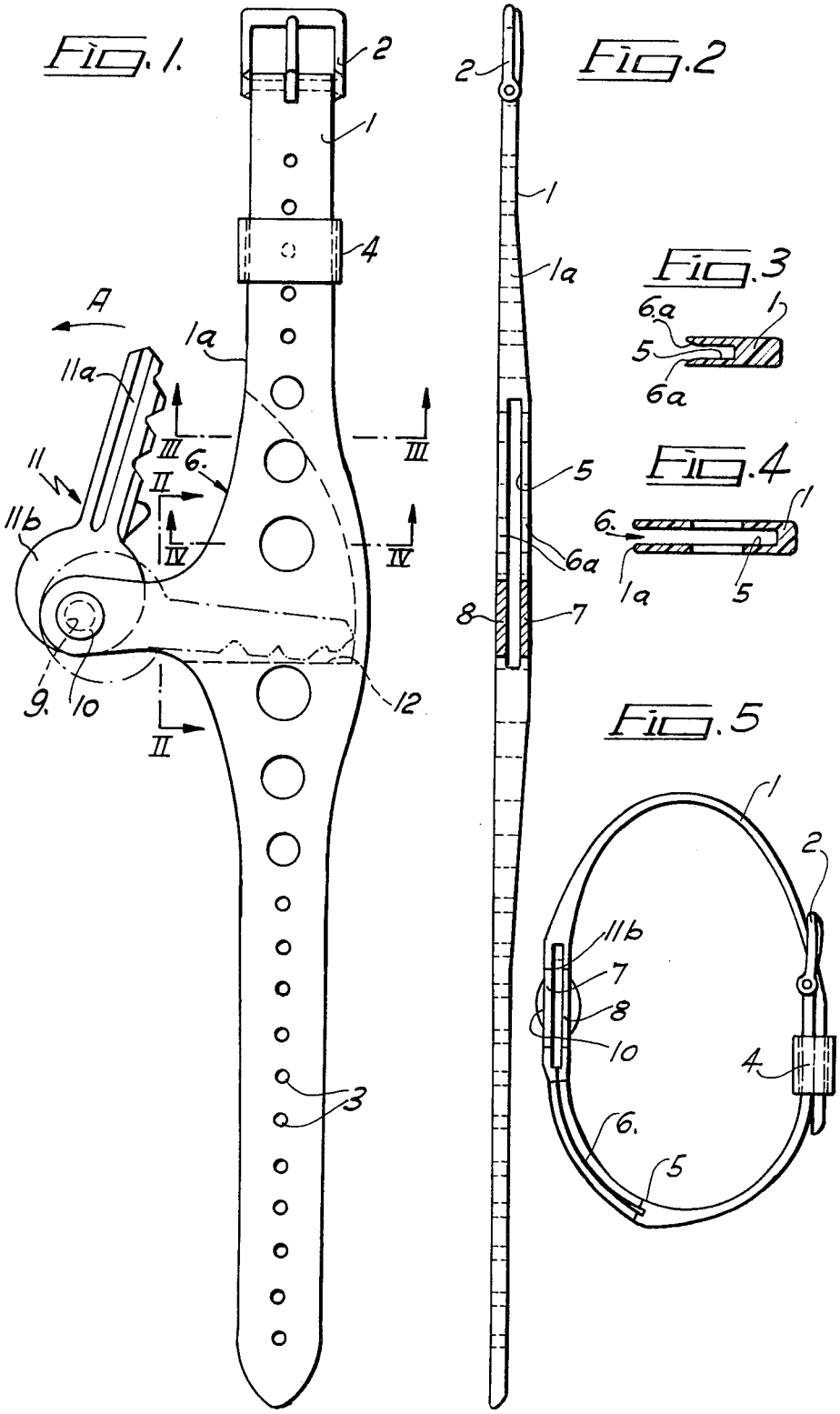

In the drawing, the number 1 denotes a strap consisting of flexible synthetic resin, wherein this resin possesses a certain elasticity, so that the strap when taken off reverts spontaneously to its elongated (flat) position. The strap 1 has at one end a buckle 2, and at the other end is provided with holes 3 for the spike of the buckle. Further, a loop 4 is provided in the usual way for pushing through the end of the strap that is provided with holes. In the middle part the strap 1 possesses a pocket 5 open toward a narrow face 1*a* of the strap. The mouth of the pocket is denoted by 6. At the mouth 6 of the pocket, the strap 1 has two parallel lugs 7,8, at a distance apart, extending substantially at right angles to the narrow face 1*a* and in the plane of the strap (when the strap is stretched out). Near to their free ends the lugs are each provided with a drilling or hole 9 for a pivot pin 10 defining the swivel axis of the key 11 disposed between the lugs. With the key it is a matter of an ordinary cylinder-lock key, which consists of the key-bit 11*a* and the disc-shaped key handle 11*b*. The key 11 is pivotable about the axis of the pivot pin 10 extending perpendicular to the plane of the strap. In the swung-in position the key, as is shown dotted in FIG. 1, extends substantially at right angles to the length of the strap.

Preferably,the pocket 5 has a mouth 6 only on the one side of the two lugs 7,8, and has in its interior a stop 12 for the key. In this way it is always ensured that the key can be swivelled into the pocket 5 only so far as to make the key-bit approximately perpendicular to the length of the strap. This then has the advantage that the pocket 5, as will be described in more detailed later, closes satisfactorily when the bracelet is put on and a swivelling out of the key is avoided with certainty. Moreover, the key cannot swivel out unintentionally if the stretched-out strap is hung up by the buckle 2 on a key board.

As is further apparent, especially from FIG. 1, the lugs 7,8 are narrower in the plane of the strap than is the key handle 11*b*. The key handle 11*b* consequently protrudes laterally beyond the lugs and it can readily be gripped by the fingers to swivel the key out.

To facilitate the swivelling-in of the key, the edges 6*a* of the mouth 6 of the pocket are bevelled toward the inside of the pocket, as can be seen from FIG. 3. By these bevellings the key-bit 11*a* is guided into the pocket 5 when the key is swivelled in.

For the pivot pin 10, either a rivet joint or else a screw with a flat head and a corresponding flat nut can be employed.

To lock and unlock the cloakroom locker, the key is swivelled in the direction A out of the pocket 5 of the elongated strap to the point where the key-bit which is then pointing away from the strap is approximately perpendicular to the lengthwise direction of the latter. The cloakroom locker can then be easily locked or unlocked with the key, the strap being no hindrance in this because the key can be held conveniently by its handle 11*b*. After the key 11 has been swivelled into the pocket 5, the latter protectively accommodates the key-bit which is often sharpedged. When the bracelet is put on to the arm or lower leg, the strap is bowed as illustrated in FIG. 5. Thereby the pocket 5 also becomes curved, so that the key can no longer be swivelled out. Through the curving of the strap the mouth 6 of the pocket is also closed, as is shown in FIG. 5. They key cannot swivel out unless the cloakroom bracelet is taken off. When, however, the cloakroom bracelet is taken off, it automatically assumes its elongated position, and the key can easily be swivelled out of the pocket.

The strap 1 with the pocket 5 and the lugs 7,8 can be fabricated cheaply as an injection molding of synthetic resin. Since the strap or its lugs themselves serve to accommodate the swivel axis of the key, the swivel joint between key and strap can also be made cheaply.

The embodiments of the invention in which an exclusive property or privilege is claimed are defined as follows:

1. In a cloakroom bracelet for bathing establishments and the like, consisting of a flexible strap made of synthetic resin, which has at one end a buckle and in its middle part a recess for the accommodation of a flat key having a key handle joined on a pivot to the strap, the improvement comprising wherein said recess is designed as a pocket which opens toward one of the narrow faces of the strap, said key handle being pivotal into or out of said pocket about an axis extending at right angles to the plane of said strap and piercing said strap, said strap, on the side where the mouth of said pocket is, having two parallel lugs set at a distance apart and extending substantially at right angles to said narrow face and in the plane of said strap, each of said lugs having near its free end a hole for a pivot axis of said key located between said lugs, said key when in its swung-in position extending substantially at right angles to the lengthwise direction of said strap.

2. The improved cloakroom bracelet according to claim 1, wherein said pocket has a mouth only on the one side of said two lugs and has inside it a stop for the key-bit.

3. The improved cloakroom bracelet according to claim 1, wherein said lugs in the plane of the strap are narrower than the key handle.

4. The improved cloakroom bracelet according to claim 1, wherein the edges of the pocket mouth are bevelled toward the inside of the pocket.

* * * * *